United States Patent [19]

Bergner et al.

[11] 4,276,097

[45] Jun. 30, 1981

[54] METHOD OF TREATING $SM_2CO_{17}$-BASED PERMANENT MAGNET ALLOYS

[75] Inventors: Robert L. Bergner, San Jose, Calif.; Frederick Rothwarf, Toms River; Arthur Tauber, Elberon, both of N.J.

[73] Assignee: The United States of America as represented by the Secretary of the Army, Washington, D.C.

[21] Appl. No.: 145,934

[22] Filed: May 2, 1980

[51] Int. Cl.[3] ..... H01F 1/02

[52] U.S. Cl. ..... 148/101; 148/31.57

[58] Field of Search ..... 75/152, 153, 170, 173; 148/101, 102, 121, 31.57

[56] References Cited

U.S. PATENT DOCUMENTS 4,213,802 7/1980 Rothwarf et al. ..... 148/101

OTHER PUBLICATIONS

"Enhancement of the Magnetic Properties of the $Sm_2Cu_{1.6}Zr_{0.16}Fe_{3.3}Co_{12}$, Compound", Bergner et al, Conference on Magnetism and Magnetic Materials, Cleveland, Ohio, Nov. 15, 1978.

Magnetic Properties of a New Type of Rare-Earth Cobalt Magnets", Ojima et al., IEEE Transactions on Magnetics, vol. 66-13, No. 5, Sep. 1977.

*Primary Examiner*—L. Dewayne Rutledge
*Assistant Examiner*—John P. Sheehan
*Attorney, Agent, or Firm*—Nathan Edelberg; Jeremiah G. Murray; Roy E. Gordon

[57] ABSTRACT

The reversible temperature coefficient of magnetization of a permanent magnet alloy over the temperature range from −50 degrees C. to +150 degrees C. is lowered by heat treating the alloy in a noble gas atmosphere or in a vacuum by the steps of (a) heating the alloy at about 1150 degrees C. for 1.5 hours (b) quenching the alloy in ice water, (c) heating the alloy at about 940 degrees C. for 2 hours, (d) lowering the temperature to about 700 degrees C. and heating for one hour, (e) lowering the temperature to about 600 degrees C. and heating for one hour, (f) lowering the temperature to about 500 degrees C. and heating for 2 hours, and (g) lowering the temperature to about 400 degrees C. and heating for 10 hours.

7 Claims, No Drawings

METHOD OF TREATING $SM_2CO_{17}$-BASED PERMANENT MAGNET ALLOYS

The invention described herein may be manufactured, used, and licensed by or for the Government for governmental purposes without the payment to us of any royalty thereon.

This invention relates to a method of treating a $Sm_2Co_{17}$-based permanent magnet alloy and in particular to a method of lowering the reversible temperature coefficient of magnetization of the permanent magnet alloy $Sm_2Cu_{1.6}Zr_{0.16}Fe_{3.3}Co_{12}$ over the temperature range from −50 degrees C. to +150 degrees C. This application is copending with U.S. patent application Ser. No. 033,940 filed Apr. 27, 1979, now U.S. Pat. No. 4,213,802, for "Method Of Treating A Permanent Magnet Alloy" and assigned to a common assignee.

BACKGROUND OF THE INVENTION

There is a need in some millimeter wave/microwave devices of low temperature coefficient permanent magnet materials in which the temperature coefficient of magnetization is low enough such that the variation of remanent magnetization is less than 2 percent over the temperature range of −50 degrees C. to +150 degrees C. The current commercially available $SmCo_5$ based magnets have a rather high reversible temperature coefficient (RTC) of magnetization of −0.044 percent/C.

There has recently been reported a $Sm_2Co_{17}$-based alloy having an improved energy product as compared to $SmCo_5$-based compounds. The alloy has the composition $Sm_2Cu_{1.6}Zr_{0.16}Fe_{3.3}Co_{12}$. Though the alloy has an improved energy product, its reversible temperature coefficient of magnetization is too high.

In U.S. Pat. No. 4,213,802, a heat treatment is disclosed and claimed that improves the temperature coefficient of magnetization of the alloy $Sm_2Cu_{1.6}Zr_{0.16}Fe_{3.3}Co_{12}$ by a factor of about 2.

SUMMARY OF THE INVENTION

The general object of this invention is to provide a method of lowering the RTC of magnetization of permanent magnet materials. A further object of the invention is to provide such a method wherein the permanent magnet material is a $Sm_2Co_{17}$-based alloy. A particular object of the invention is to provide such a method that improves the RTC of magnetization of the alloy $Sm_2Cu_{1.6}Zr_{0.16}Fe_{3.3}Co_{12}$ as obtained by the U.S. Pat. No. 4,213,802 treatment.

It has now been found that the foregoing objects can be attained by heat treating the alloy in vacuum or in a noble gas atmosphere according to the schedule:

(a) 1150 degrees C. for 1.5 hours
(b) quench in ice water
(c) 940 degrees for 2 hours
(d) 700 degrees for 1 hour
(e) 600 degrees for 1 hour
(f) 500 degrees for 2 hours
(g) 400 degrees for 10 hours

DESCRIPTION OF THE PREFERRED EMBODIMENT $Sm_2Cu_{1.6}Zr_{0.16}Fe_{3.3}Co_{12}$ is prepared by induction melting the appropriate constituents in a boron nitride crucible in an over-pressure of 60 p.s.i., argon atmosphere in a crystal growing furnace. The cast ingots are then treated, according to the above schedule. The resulting RTC is −0.011 percent/C.

When the cast ingots are heat treated according to the method of Ser. No. 033,940, the resulting RTC is −0.022 percent/C.

Thus, the method of the invention improves the temperature coefficient by a factor of about two over the best previous result.

The precise reason that the change in heat schedule affects the RTC of magnetization is not known. What is known, however, from microprobe studies, is that a significant variation in the size and composition of the principal and the grain boundary phases occurs with different heat treatments.

It also is to be noted that the invention results in the attainment of a high energy product (BH) in an alloy together with a relatively low temperature coefficient needed to meet various device requirements.

We wish it to be understood that we do not desire to be limited to the exact details as described, for obvious modifications will occur to a person skilled in the art.

What is claimed is:

1. Method of lowering the reversible temperature coefficient of magnetization of a permanent magnet alloy, said method consisting of heat treating the alloy in an atmosphere selected from the group consisting of noble gas and vacuum by the steps of (a) heating the alloy at about 1150 degrees C. for 1.5 hours, (b) quenching the alloy in ice water, (c) heating the alloy at about 940 degrees C. for 2 hours, (d) lowering the temperature to about 700 degrees C. and heating for one hour, (e) lowering the temperature to about 600 degrees C. and heating for one hour, (f) lowering the temperature to about 500 degrees C. and heating for 2 hours, and (g) lowering the temperature to about 400 degrees C. and heating for 10 hours.

2. Method according to claim 1 wherein the alloy is heat treated in a vacuum.

3. Method according to claim 1 wherein the alloy is heat treated in a noble gas atmosphere.

4. Method according to claim 3 wherein the noble gas is argon.

5. Method according to claim 1 wherein said permanent magnet alloy is a $Sm_2Co_{17}$-based alloy.

6. Method according to claim 5 wherein said $Sm_2Co_{17}$-based alloy is $Sm_2Cu_{1.6}Zr_{0.16}Fe_{3.3}Co_{12}$.

7. Method of lowering the reversible temperature coefficient of magnetization of the permanent magnet alloy $Sm_2Cu_{1.6}Zr_{0.16}Fe_{3.3}Co_{12}$, said method consisting of heat treating the alloy in an argon atmosphere by the steps of (a) heating the alloy at about 1150 degrees C. for 1.5 hours, (b) quenching the alloy in ice water, (c) heating the alloy at about 940 degrees C. for 2 hours, (d) lowering the temperature to about 700 degrees C. and heating for one hour, (e) lowering the temperature to about 600 degrees C. and heating for one hour, (f) lowering the temperature to about 500 degrees C. and heating for 2 hours, and (g) lowering the temperature to about 400 degrees C. and heating for 10 hours.

* * * * *